US009840001B2

(12) United States Patent
Neubauer et al.

(10) Patent No.: US 9,840,001 B2
(45) Date of Patent: Dec. 12, 2017

(54) SOLID STATE TOOL SYSTEM

(71) Applicant: Fiskars Brands, Inc., Madison, WI (US)

(72) Inventors: Mark Neubauer, Canby, OR (US); Hal Hardinge, Tigard, OR (US)

(73) Assignee: Fiskars Brands, Inc., Middleton, WI (US)

( * ) Notice: Subject to any disclaimer, the term of this patent is extended or adjusted under 35 U.S.C. 154(b) by 236 days.

(21) Appl. No.: 14/796,636

(22) Filed: Jul. 10, 2015

(65) Prior Publication Data

US 2016/0008968 A1 Jan. 14, 2016

Related U.S. Application Data

(60) Provisional application No. 62/023,649, filed on Jul. 11, 2014.

(51) Int. Cl.
*B25F 1/02* (2006.01)
*B25B 15/00* (2006.01)
(Continued)

(52) U.S. Cl.
CPC ..... *B25F 1/02* (2013.01); *B25B 15/005* (2013.01); *B25B 15/008* (2013.01); *B25B 15/02* (2013.01); *B25F 1/04* (2013.01)

(58) Field of Classification Search
CPC .... B25F 1/02; B25F 1/04; B25F 1/003; B25B 15/02; B25B 15/005; B25B 15/008
See application file for complete search history.

(56) References Cited

U.S. PATENT DOCUMENTS 4,960,016 A * 10/1990 Seals ..... B25F 1/02 7/100
5,655,242 A * 8/1997 Chuang ..... B25B 13/04 7/100

(Continued)

FOREIGN PATENT DOCUMENTS

CN 203317378 U 12/2013
WO WO-03/064114 A2 8/2003

OTHER PUBLICATIONS

Leatherman Tool Group, Inc., Product Description and Reviews for Leatherman GRIND multi-tool. Retrieved from the internet at: http://www.leatherman.com/grind-334.html on Jul. 7, 2015. Product known to be commercially available as of Jun. 4, 2014. 3 pages.

(Continued)

*Primary Examiner* — David B Thomas
(74) *Attorney, Agent, or Firm* — Foley & Lardner LLP

(57) ABSTRACT

A solid state tool system includes a first solid state tool, a second solid state tool, and a third solid state tool. In a first mode, the first solid state tool, the second solid state tool, and the third solid state tool are coupled to one another in a storage configuration. In a second mode, the first solid state tool is used as a tool by itself. In a third mode, the second solid state tool is used as a tool by itself. In a fourth mode, the third solid state tool is used as a tool by itself. In a fifth mode, the first solid state tool is coupled to the third solid state tool and used as a first combination tool. In a sixth mode, the second solid state tool is coupled to the third solid state tool and used as a second combination tool.

11 Claims, 21 Drawing Sheets

(51) Int. Cl.
*B25B 15/02* (2006.01)
*B25F 1/04* (2006.01)

(56) References Cited

U.S. PATENT DOCUMENTS 5,920,935 A * 7/1999 Beck ..... B25F 1/003 7/125
6,112,351 A * 9/2000 Hawkins ..... B25B 13/56 7/118
6,286,168 B1 * 9/2001 Woodruff ..... B25B 13/56 7/138
6,574,817 B2 * 6/2003 Wu ..... B25F 1/04 7/118
6,622,329 B2 * 9/2003 Ostor ..... B25B 13/56 7/138
6,637,061 B1 * 10/2003 Spracklin ..... B25B 13/48 7/138
6,739,224 B1 * 5/2004 Wershe ..... B25G 1/085 7/138
6,751,820 B1 * 6/2004 Wu ..... B25B 27/0071 30/153
7,334,502 B1 * 2/2008 Durkee ..... B25B 7/22 7/127
9,498,870 B2 * 11/2016 Davis ..... B25B 13/56 7/165
2011/0173759 A1 * 7/2011 Taiga ..... B25F 1/04 7/118
2012/0152068 A1 6/2012 Liu
2013/0097786 A1 4/2013 Hardinge et al.
2015/0135912 A1 * 5/2015 Ma ..... B25B 23/0007 81/437
2017/0066118 A1 * 3/2017 Berman ..... B26B 11/00 7/107

OTHER PUBLICATIONS

International Search Report and Written Opinion, PCT/US2015/039985, Fiskars Brands, Inc., 11 pages (Oct. 9, 2015).
English-language machine translation of CN 203317378U, Fan Zixi et al. (Dec. 4, 2013).

* cited by examiner

SOLID STATE TOOL SYSTEM

CROSS REFERENCE TO RELATED APPLICATIONS

This application claims the benefit of and priority to U.S. Provisional Application No. 62/023,649, filed Jul. 11, 2014, which is incorporated herein by reference in its entirety.

BACKGROUND

The present invention relates generally to the field of tool kits or systems.

BRIEF DESCRIPTION OF THE DRAWINGS

The invention will become more fully understood from the following detailed description, taken in conjunction with the accompanying drawings, in which.

DETAILED DESCRIPTION

Figure 1:
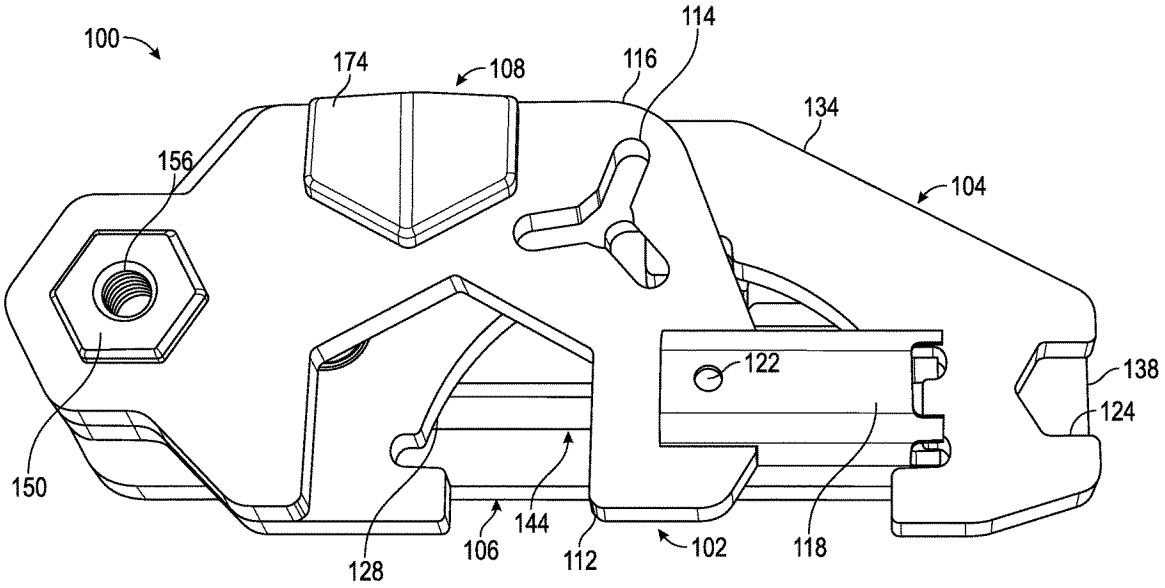
FIG. 1 is a perspective view of the Solid State Tool ("SST") system in a storage configuration.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Solid state tools ("SSTs") are hand tools that have no moving parts and are frequently made from a single piece of material. SSTs are typically very durable and easy to manufacture.

The SST system or kit disclosed herein includes two or more SSTs that can each be used individually, that can be coupled together for use as a combined tool, and that can be coupled together in a compact storage configuration. Such a system is particularly helpful as a field-carry or field-use system for a variety of specific users or users. For example, as described in more detail below, the SST system can be configured to provide a variety of tools usable with firearms (e.g., firearms in general or a particular family or type of firearms. Other SST systems can be configured to provide a variety of tools usable with cars (e.g., cars in general or particular makes and/or models of cars), bicycles (e.g., bicycles in general or particular makes and/or models of bicycles), motorcycles (e.g., motorcycles in general or particular makes and/or models of motorcycles), skateboards (e.g., skateboards in general or particular makes and/or models of skateboards), boats (e.g., boats in general or particular makes and/or models of boats), sporting equipment (e.g., sporting equipment in general, specific types of sporting equipment, like a bow, and particular makes and/or models of sporting equipment). Other SSTs systems can be configured to provide a variety of tools frequently used in various activities or by various types of users including hiking, camping, and other outdoors activities, skilled tradespeople (e.g., electricians, plumbers, etc.), military personal, first responders, etc.

The SST system 100 illustrated in the exemplary embodiment of FIGS. 1-35 is intended to allow a user to service a firearm in the field. The SST system 100 is intended to service firearms of the AR family of rifles, including AR-15, AR-10, M-16 and M-4 rifles. The SST system 100 may replace an ad hoc personal collection of tools used to service the firearm in the field. For example the user may need to adjust, tighten or disassemble various components of the firearm while in the field. A small, compact and relatively lightweight tool system enables the user to make these adjustments or disassembly the firearm in the field without needing the full-size tools typically found in an armory or workshop. The SST system 100 is intended to fit into a standard sized storage compartment that may be found in the grip or stock of a firearm, which facilitates its use as a field carry system. For example, the SST system 100 may be sized to fit into grips manufactured by Magpul Industries, including grips sold under the MOE™ and MIAD™ brands.

Figure 2:
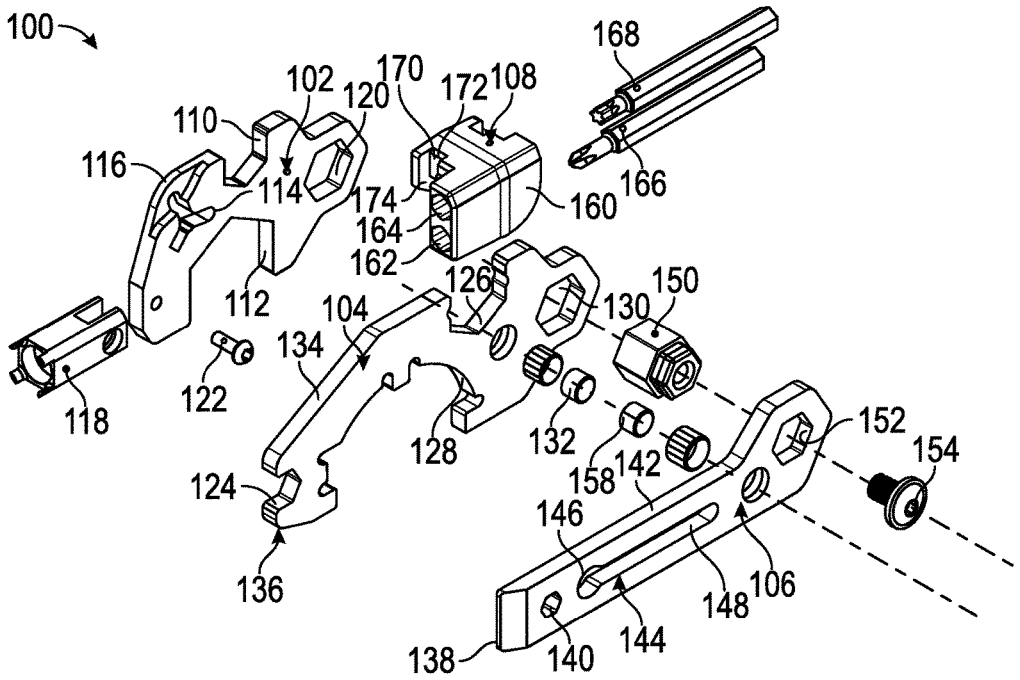
FIG. 2 is an exploded view of the SST system of FIG. 1.
Figure 3:
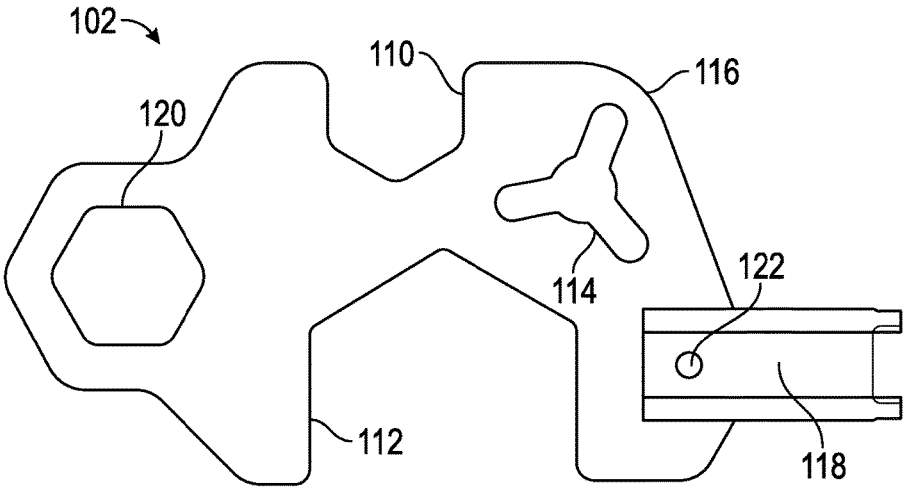
FIG. 3 is a front view of a first SST.
Figure 4:
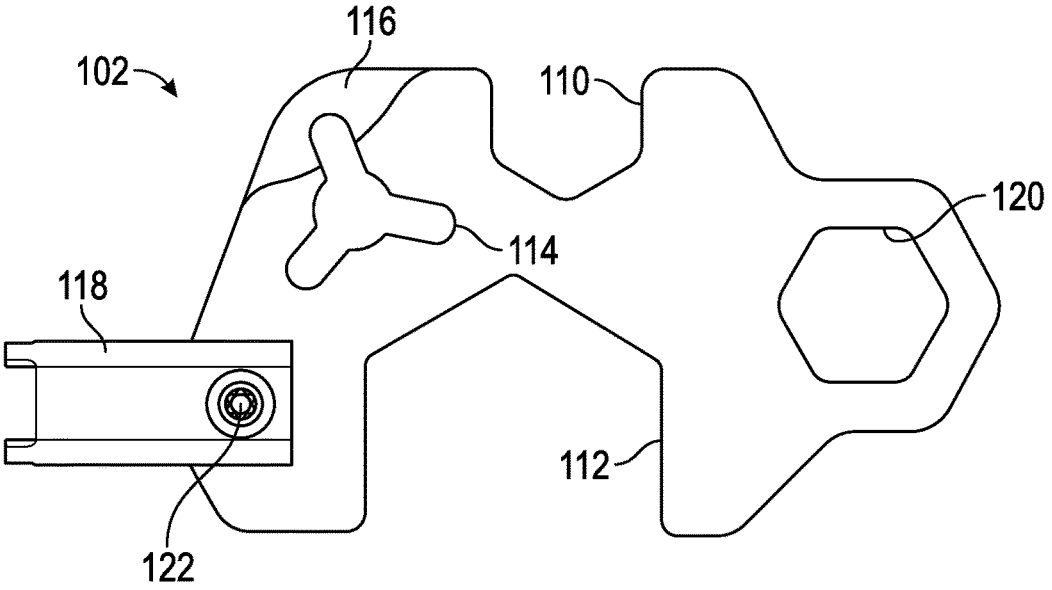
FIG. 4 is a rear view of the SST of FIG. 3.
Figure 5:
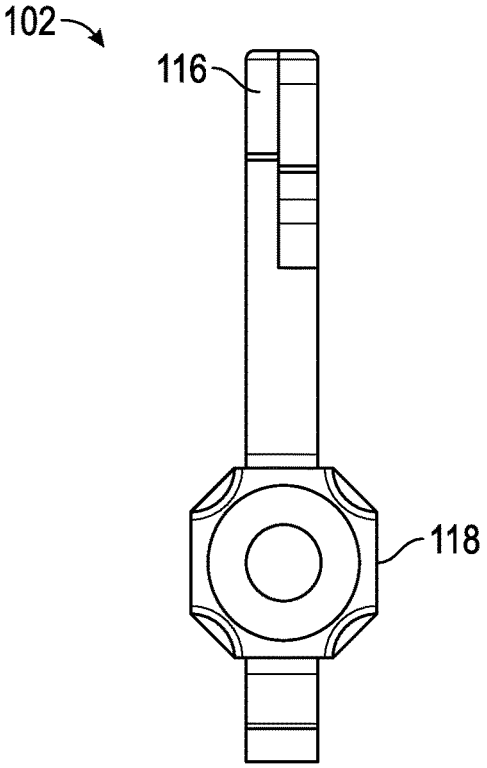
FIG. 5 is a right side view of the SST of FIG. 3.
Figure 6:
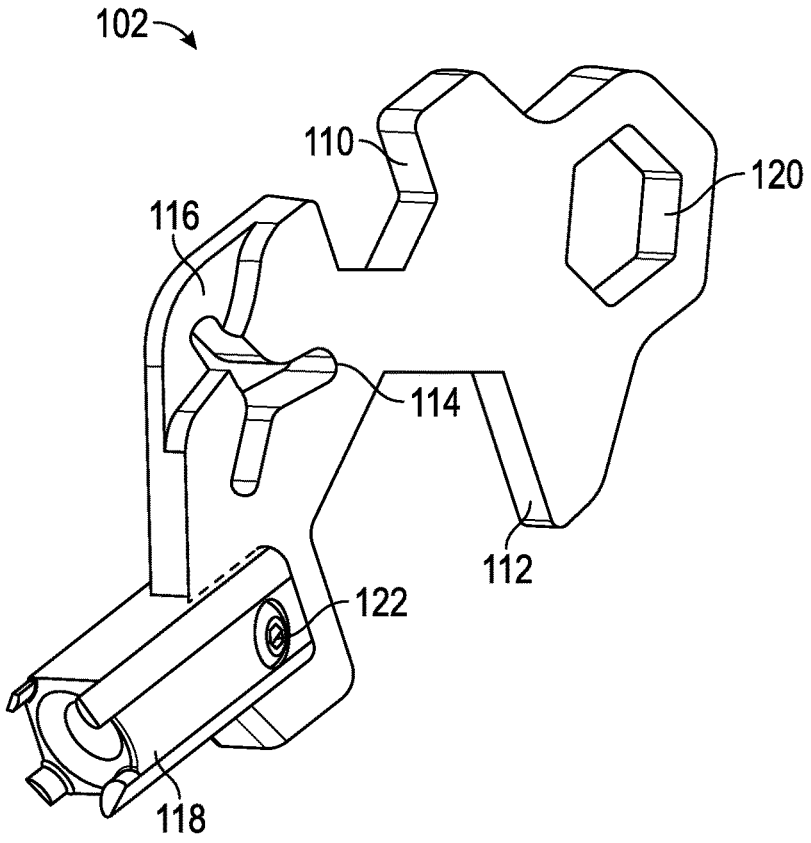
FIG. 6 is a perspective view of the SST of FIG. 3.
Figure 7:
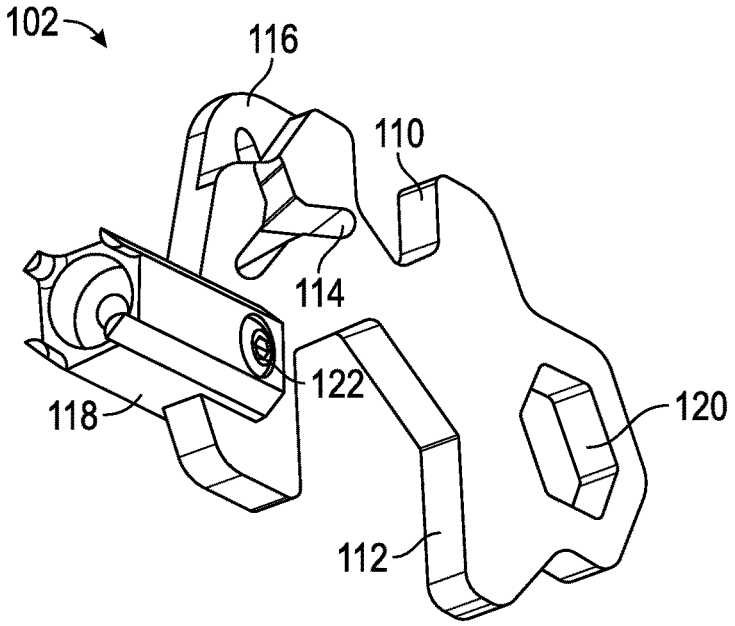
FIG. 7 is another perspective view of the SST of FIG. 3.
Figure 8:
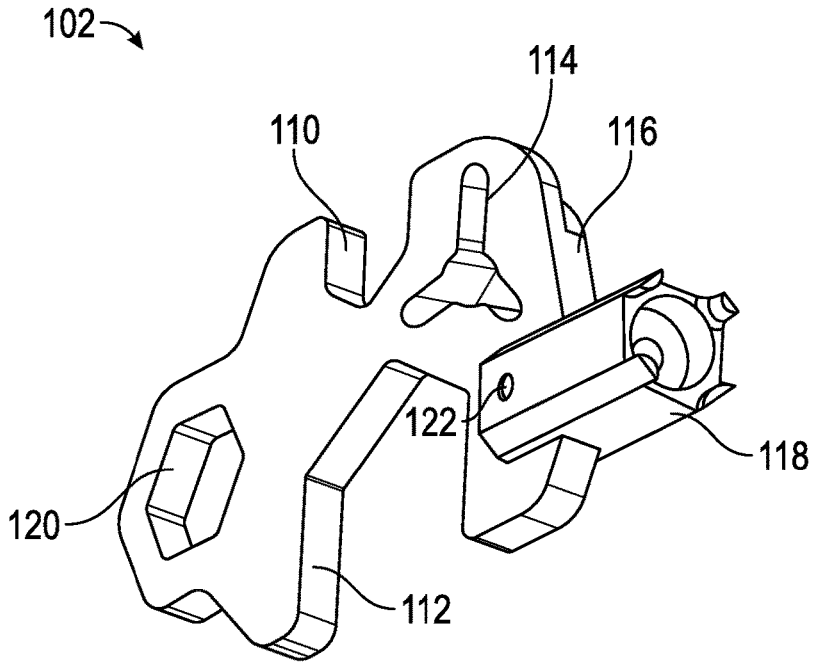
FIG. 8 is another perspective view of the SST of FIG. 3.
Figure 9:
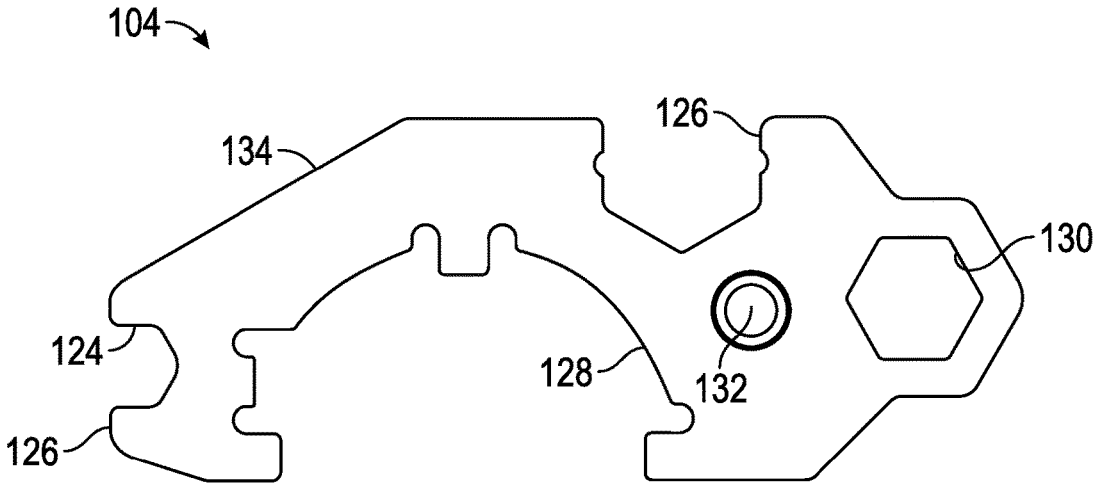
FIG. 9 is a front view of a second SST.
Figure 10:
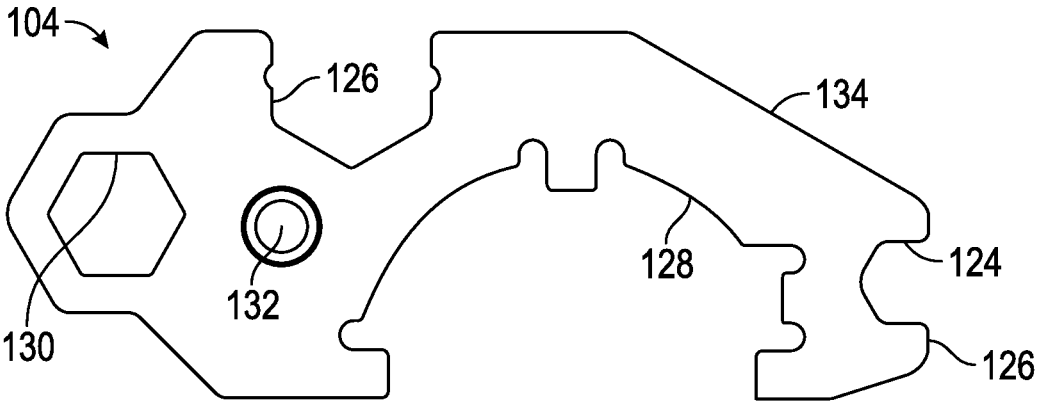
FIG. 10 is rear view of the SST of FIG. 9.
Figure 11:
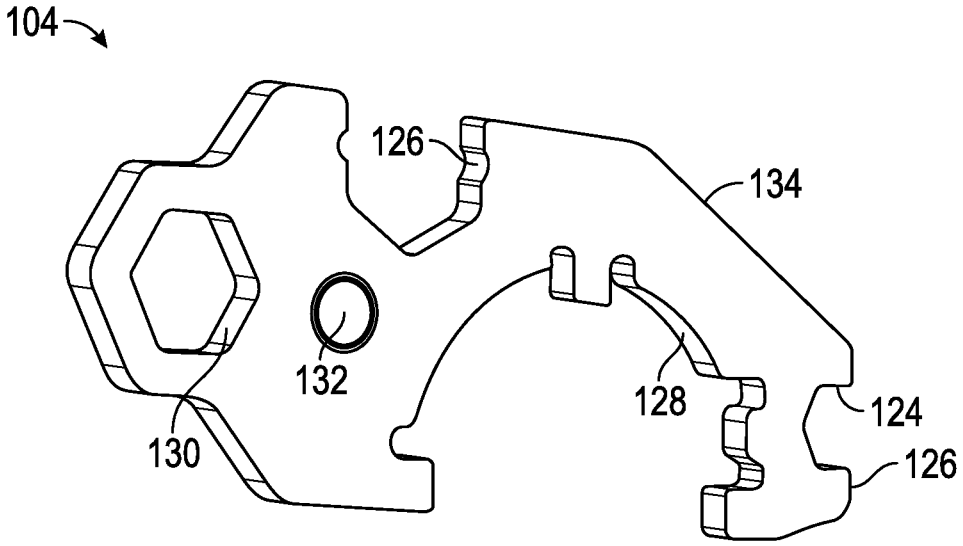
FIG. 11 is a perspective view of the SST of FIG. 9.
Figure 12:
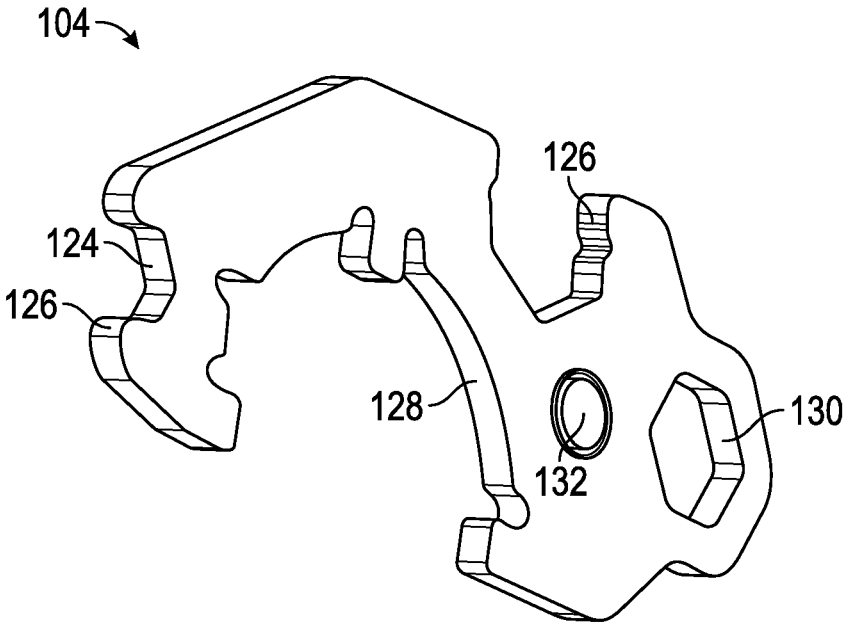
FIG. 12 is another perspective view of the SST of FIG. 9.
Figure 13:
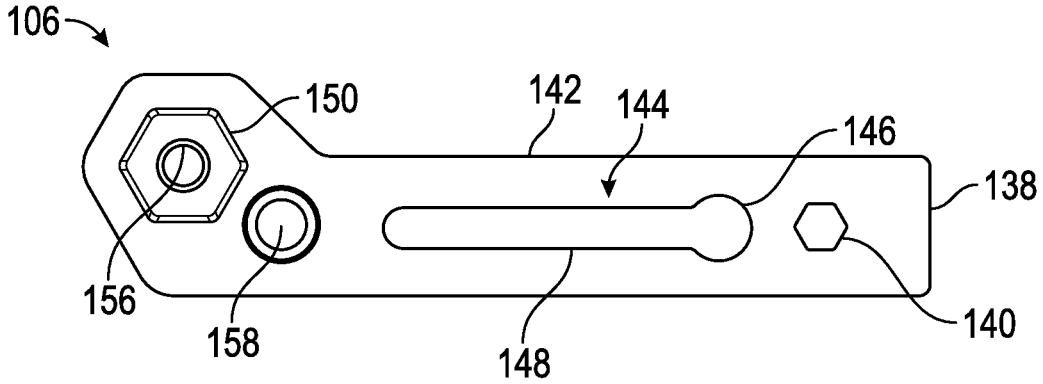
FIG. 13 is a front view of a third SST.
Figure 14:
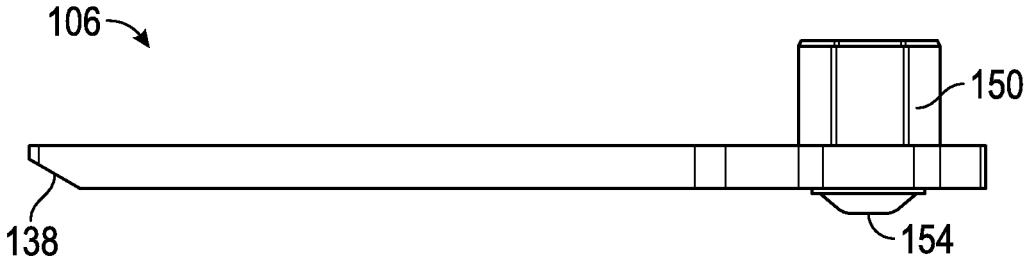
FIG. 14 is a top view of the SST of FIG. 13.
Figure 15:
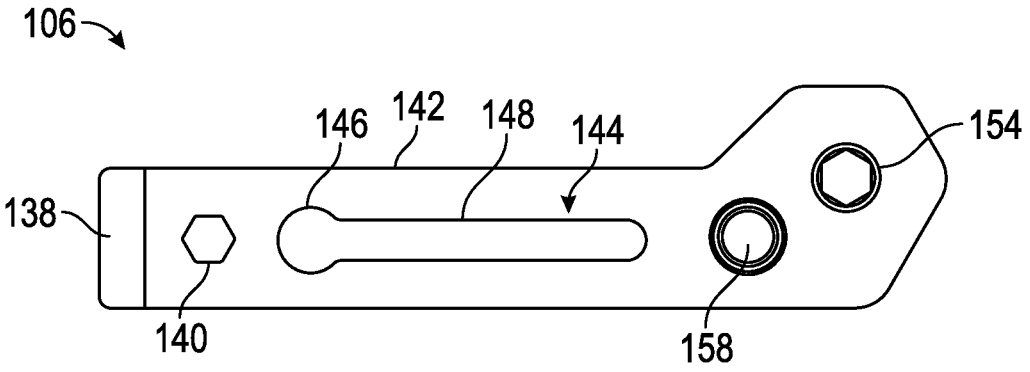
FIG. 15 is a rear view of the SST of FIG. 13.
Figure 16:
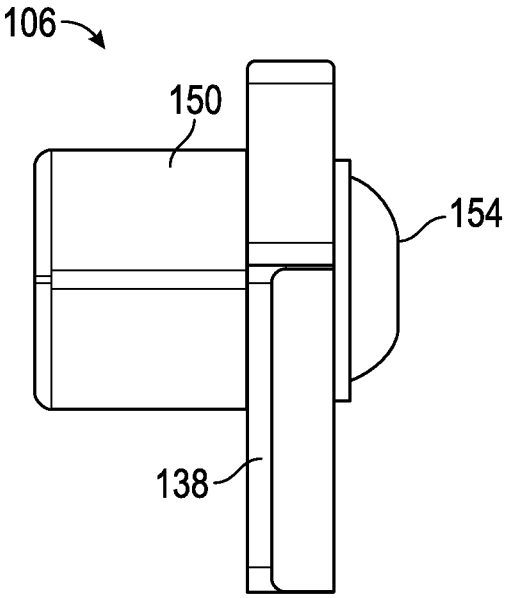
FIG. 16 is a right side view of the SST of FIG. 13.
Figure 17:
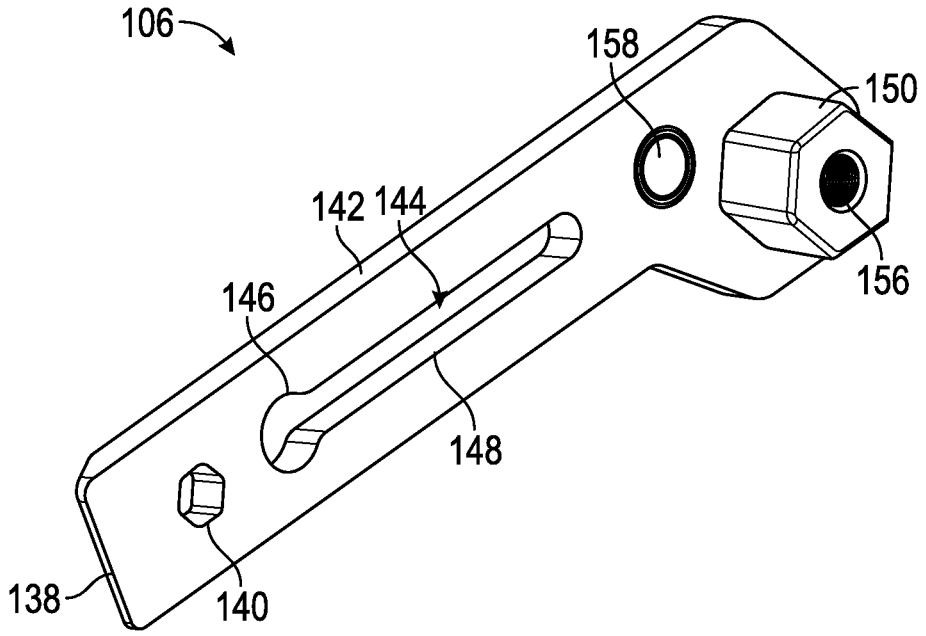
FIG. 17 is a perspective view of the SST of FIG. 13.
Figure 18:
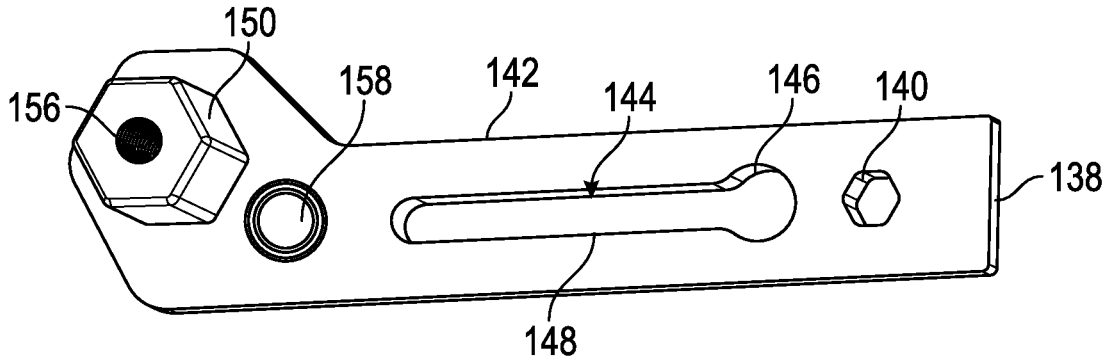
FIG. 18 is another perspective view of the SST of FIG. 13.
Figure 19:
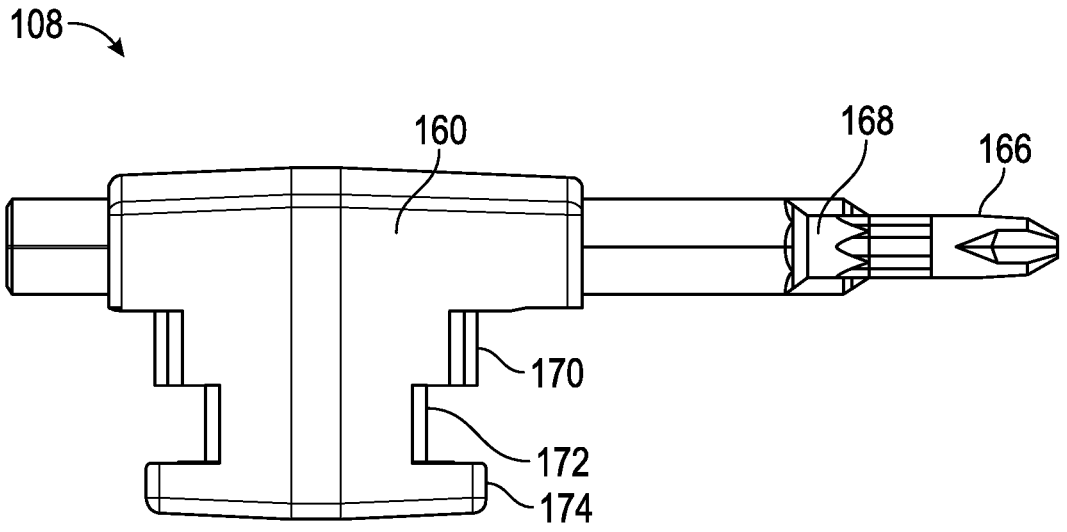
FIG. 19 is a top view of a bit holder.
Figure 20:
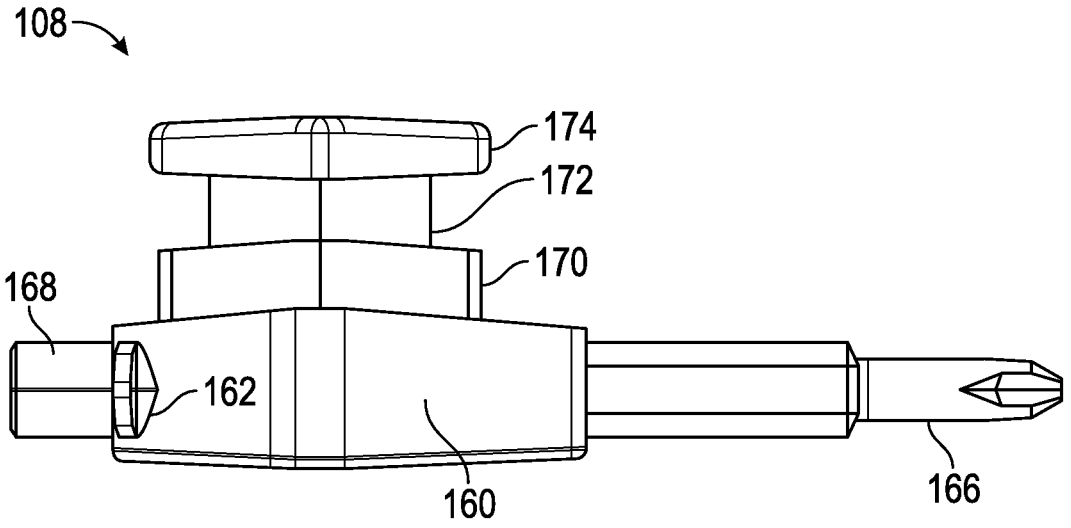
FIG. 20 is a bottom view of the bit holder of FIG. 19.
Figure 21:
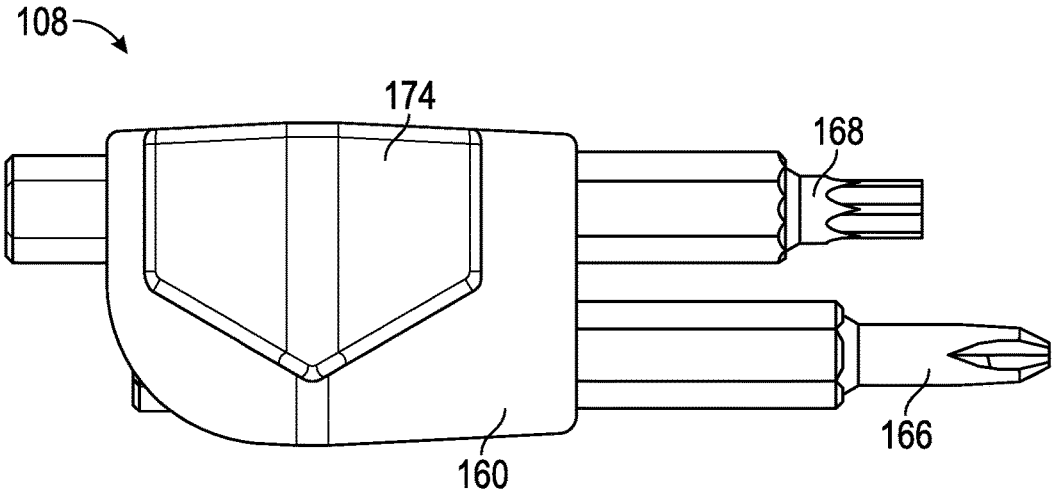
FIG. 21 is a front side view of the bit holder of FIG. 19.
Figure 22:
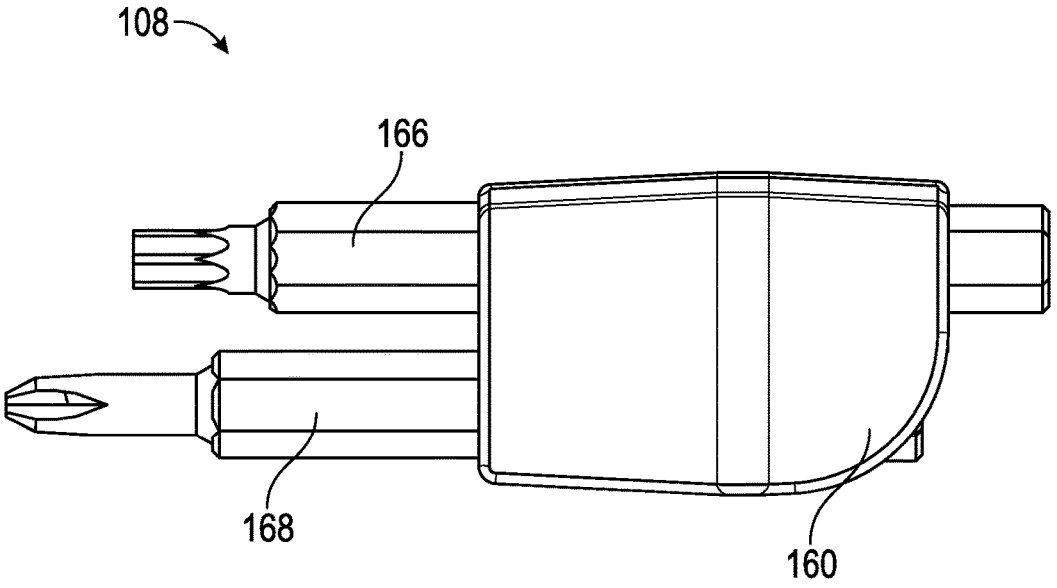
FIG. 22 is a rear view of the bit holder of FIG. 19.
Figure 22A:
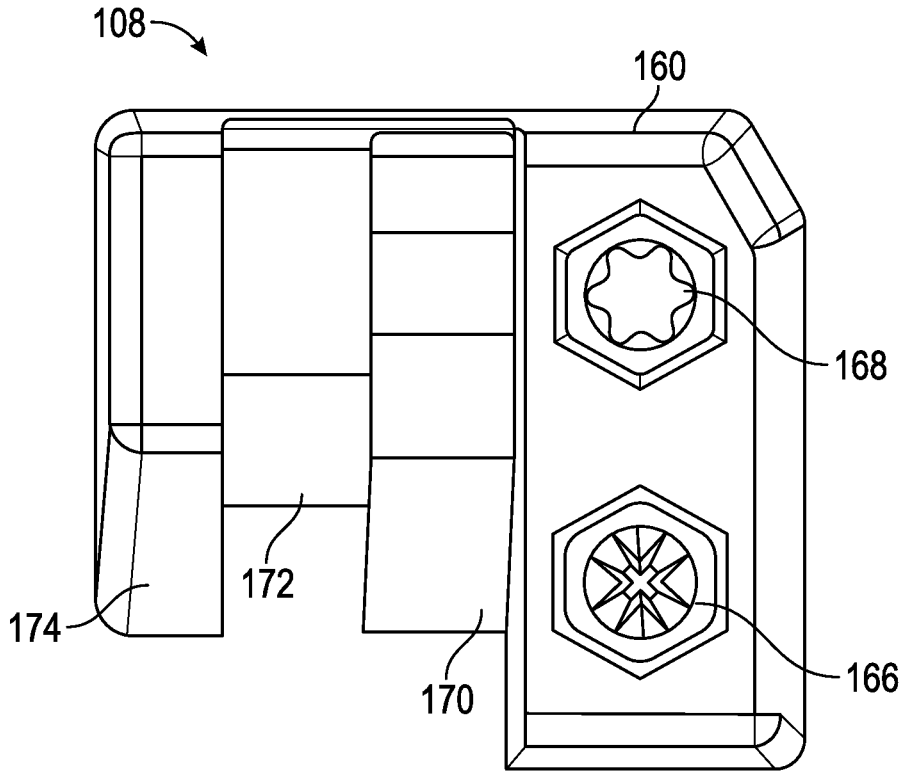
FIG. 22A is a left side view of the bit holder of FIG. 19.
Figure 22B:
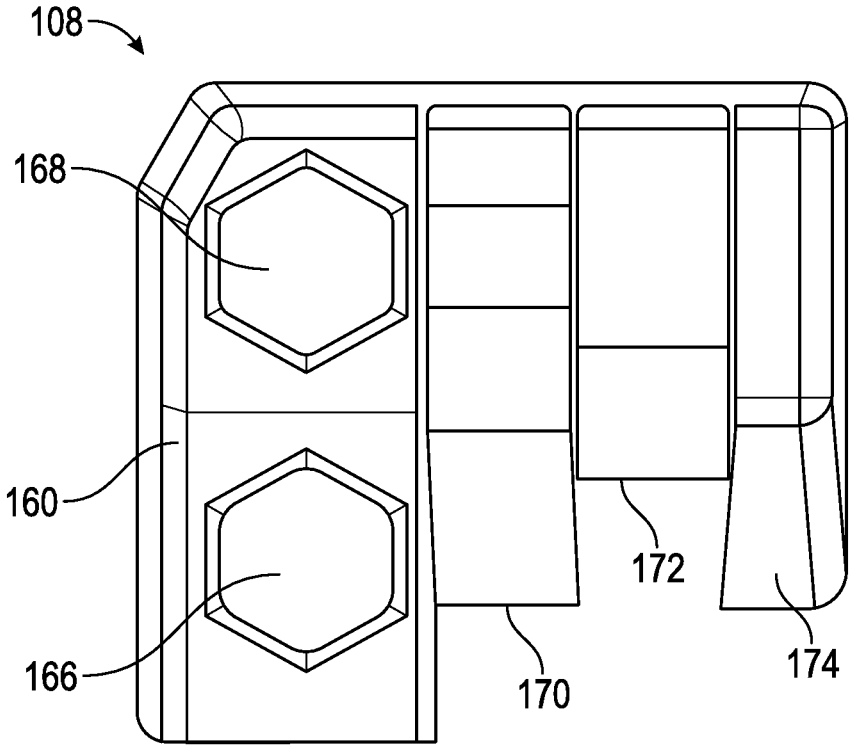
FIG. 22B is a right side view of the bit holder of FIG. 19.
Figure 23:
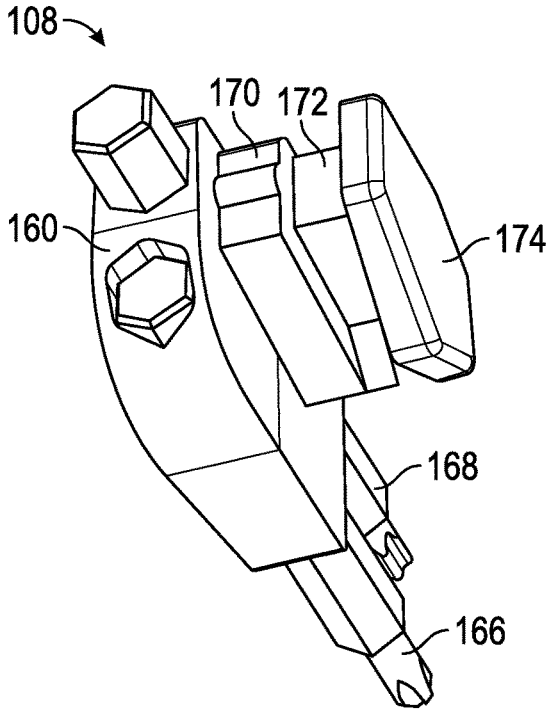
FIG. 23 is a perspective view of the bit holder of FIG. 19.
Figure 24:
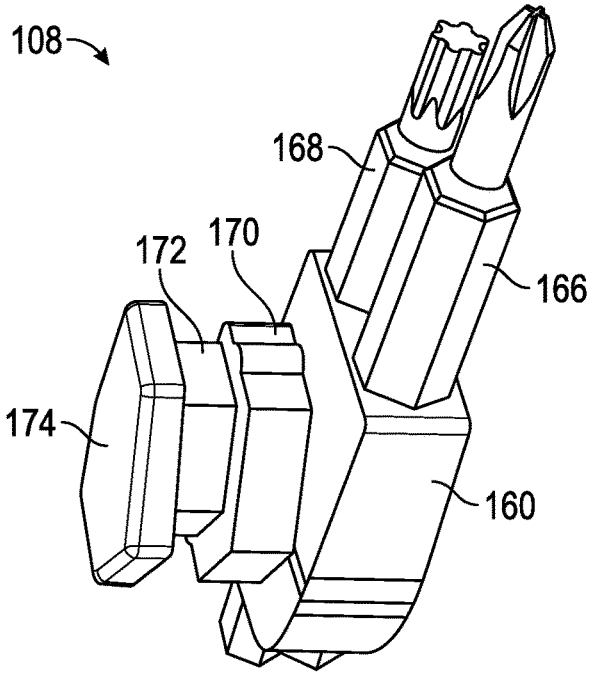
FIG. 24 is another perspective view of the bit holder of FIG. 19.
Figure 25:
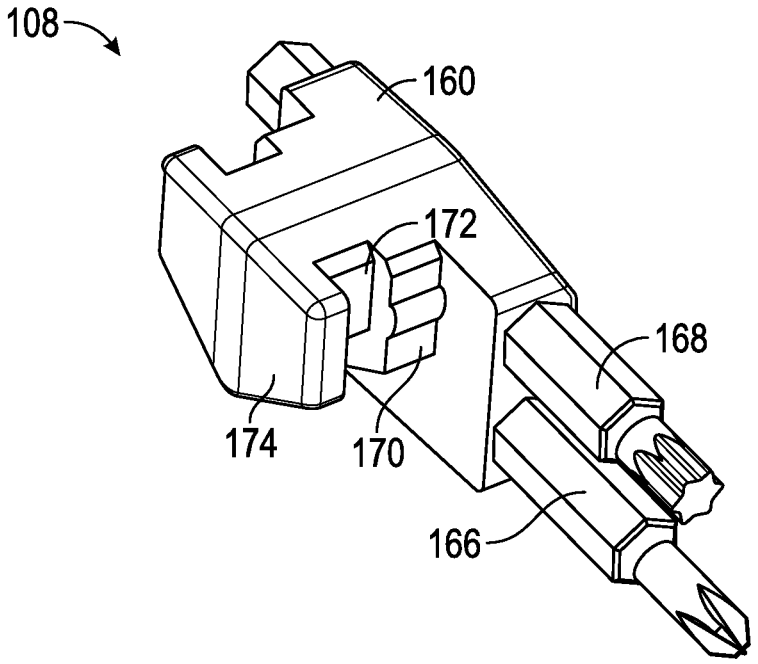
FIG. 25 is another perspective view of the bit holder of FIG. 19.
Figure 26:
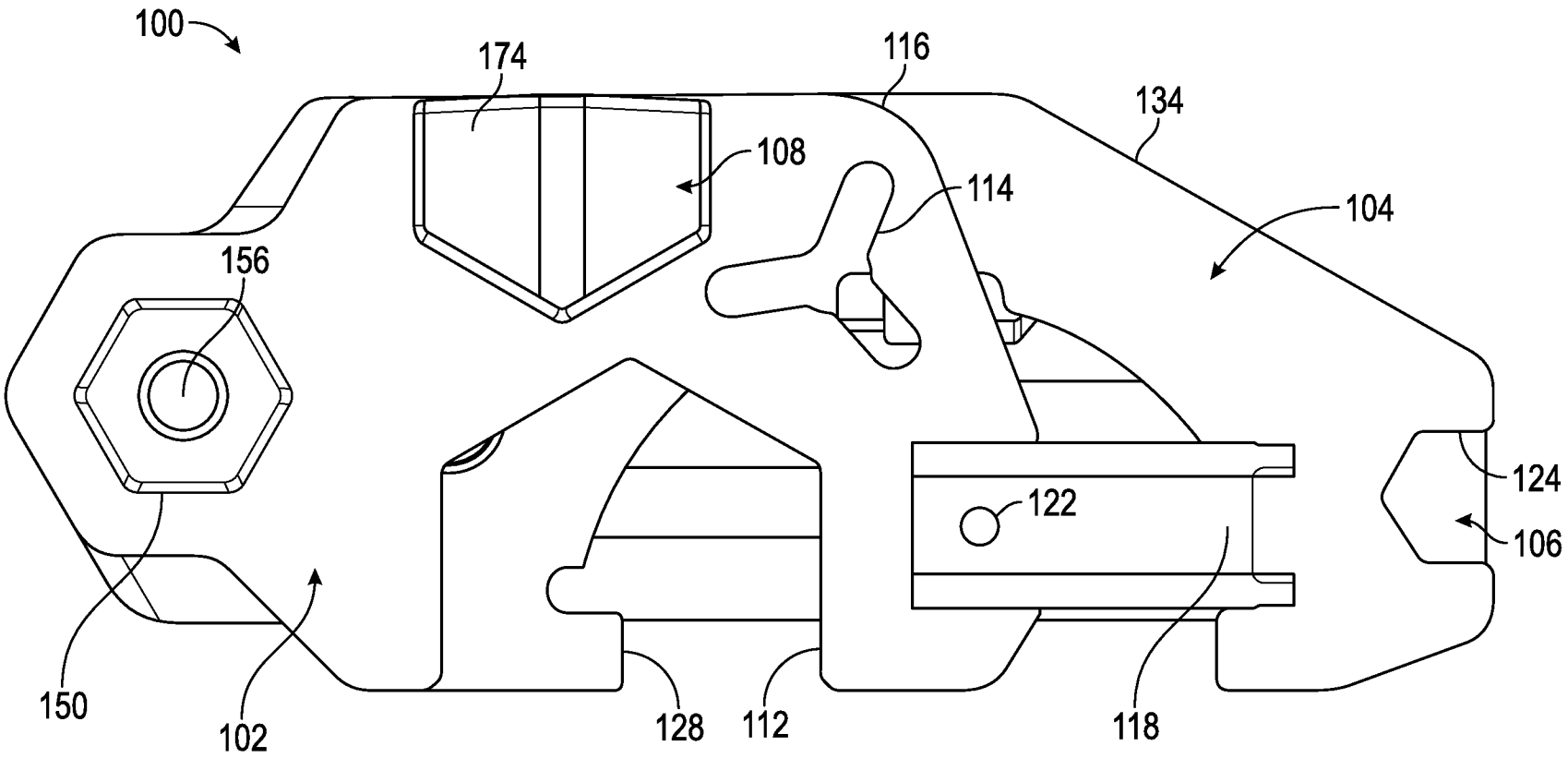
FIG. 26 is front view of the SST system of FIG. 1.
Figure 27:
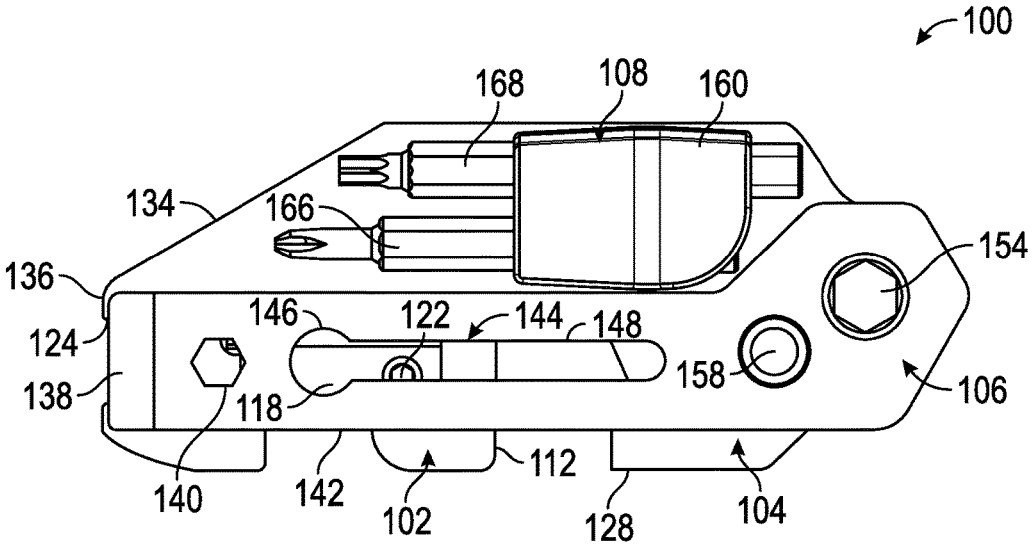
FIG. 27 is a rear view of the SST system of FIG. 1.
Figure 28:
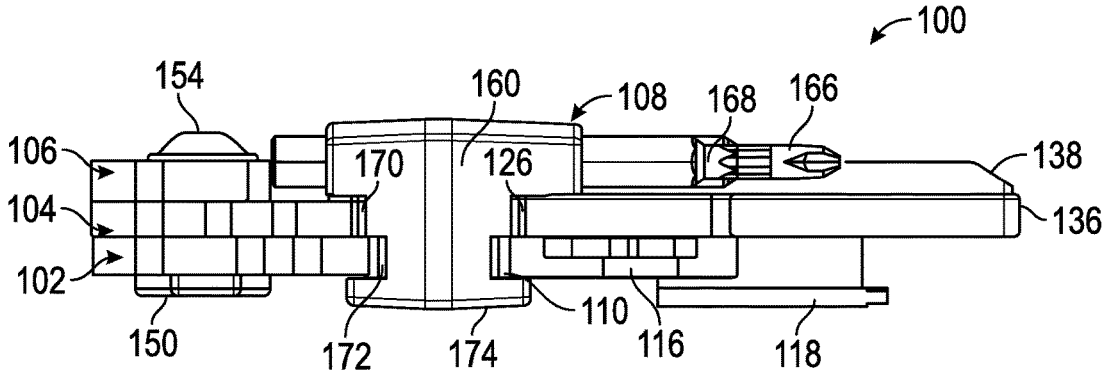
FIG. 28 is a top view of the SST system of FIG. 1.
Figure 29:
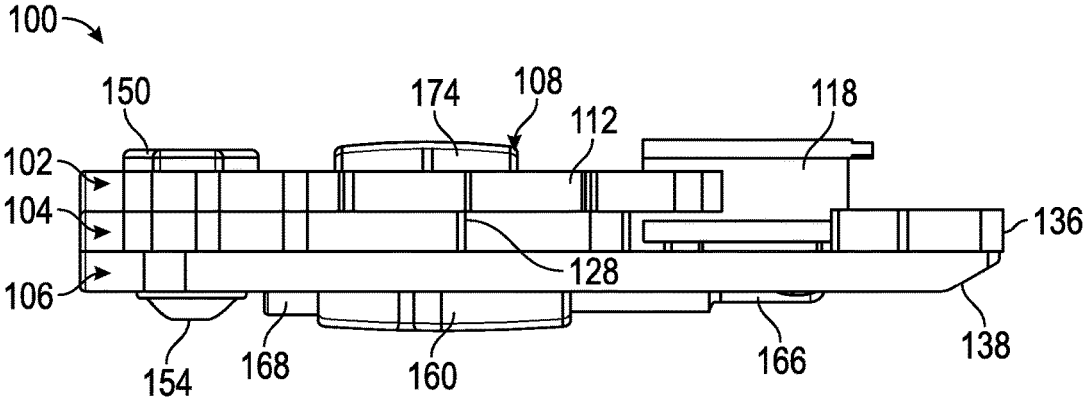
FIG. 29 is a bottom view of the SST system of FIG. 1.
Figure 30:
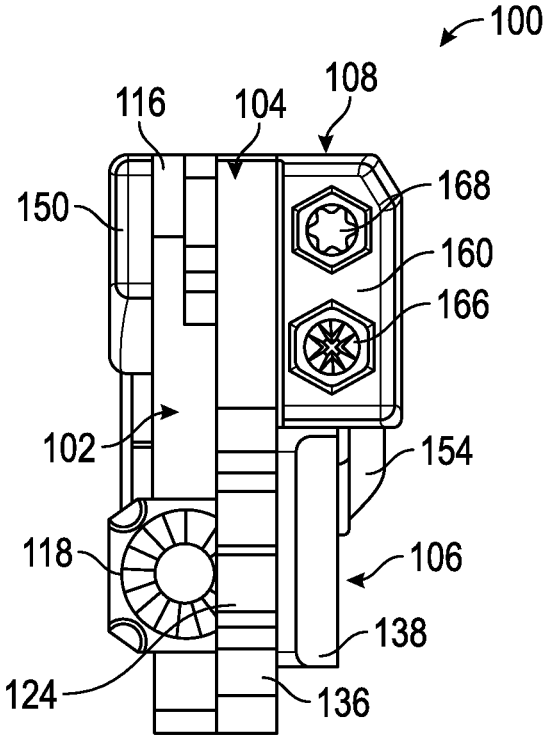
FIG. 30 is a left side view of the SST system of FIG. 1.
Figure 31:
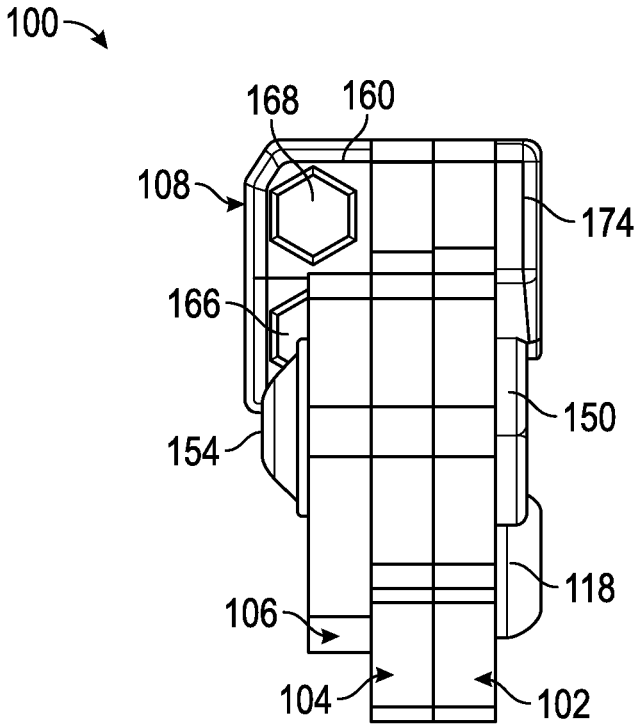
FIG. 31 is a right side view of the SST system of FIG. 1.
Figure 32:
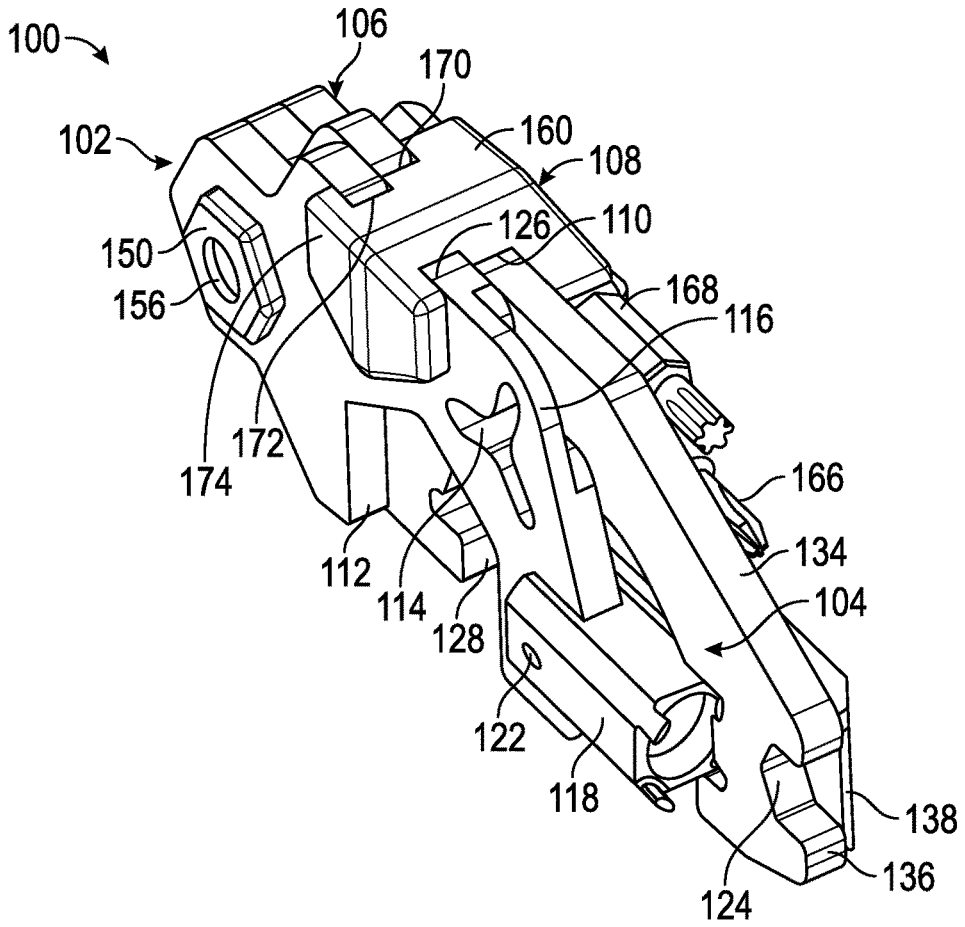
FIG. 32 is a perspective view of the SST system of FIG. 1.
Figure 33:
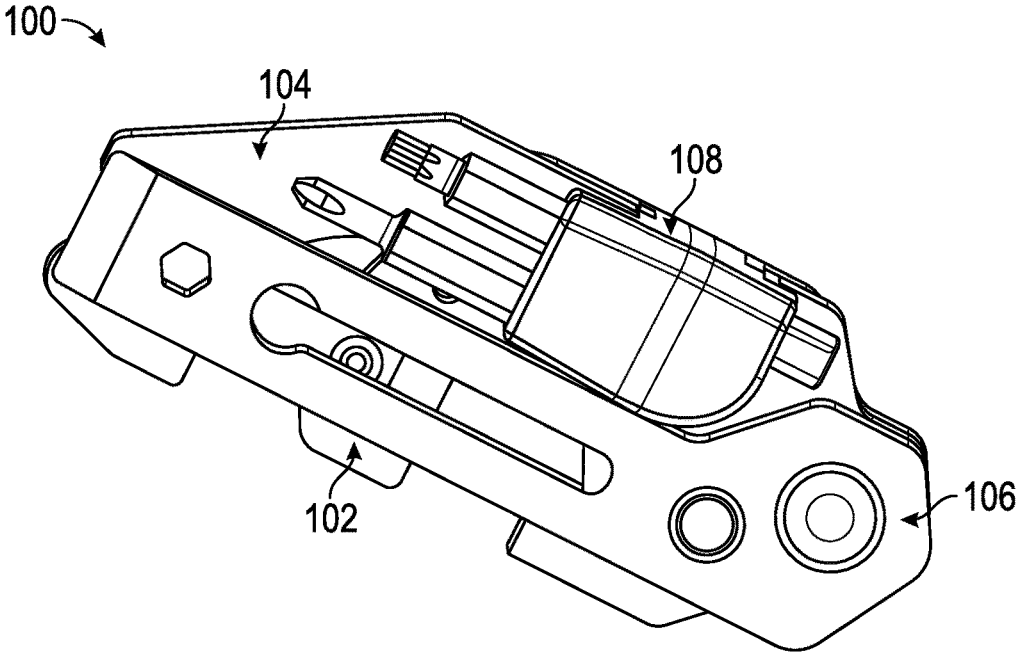
FIG. 33 is another perspective view of the SST system of FIG. 1.
Figure 34:
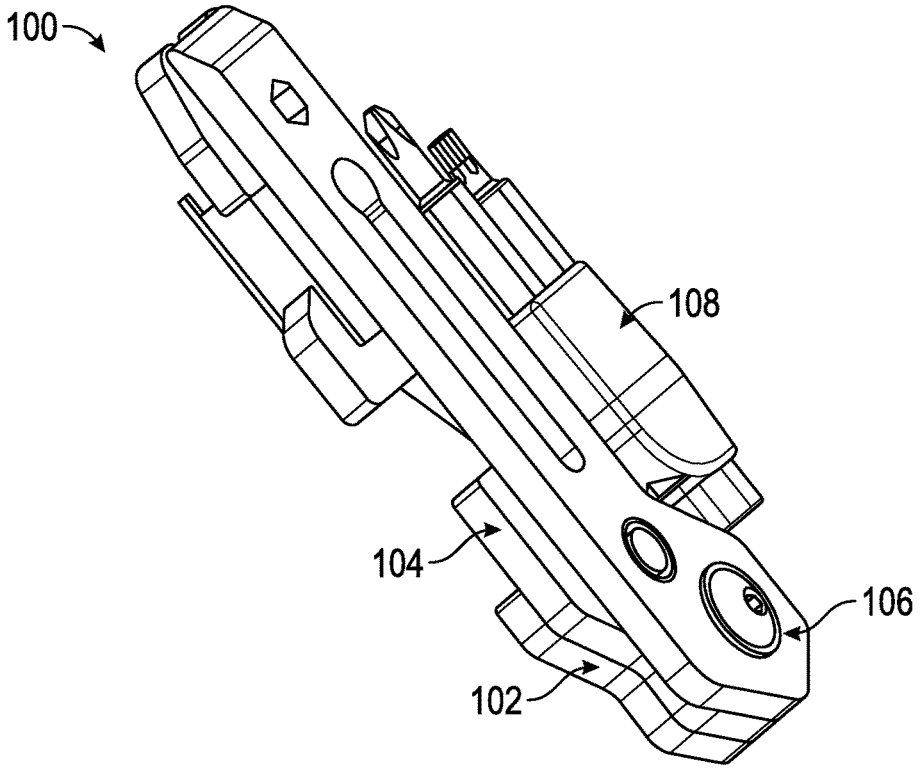
FIG. 34 is another perspective view of the SST system of FIG. 1.
Figure 35:
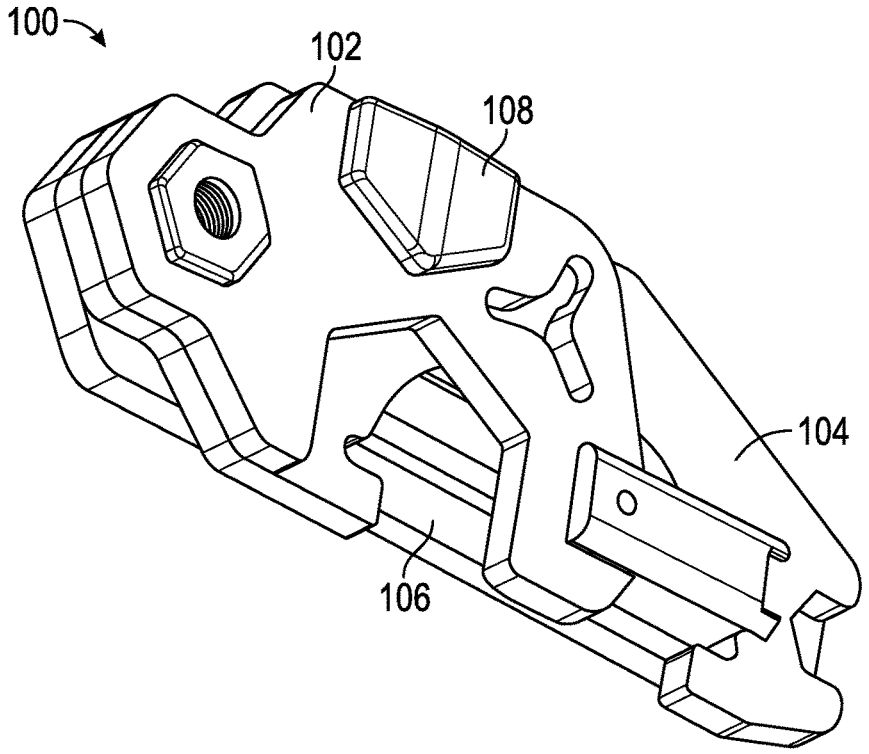
FIG. 35 is another perspective view of the SST system of FIG. 1.

As shown in FIGS. 1-2, the SST system 100 includes a first SST or wrench 102, a second SST or wrench 104, and a third SST or torque arm 106. In the illustrated embodiment, a bit holder 108 is also included, though this component may be excluded in other embodiments. In other embodiments, an SST system may include two or more SSTs usable alone and in combination in manners similar to those described herein with reference to SST system 100. Each of the three SSTs 102, 104, and 106 is usable on its own as one or more specific types of tools. For example, the first SST 102 includes multiple wrenches; each sized and shaped differently to engage different types of fasteners. Additionally, two of the SSTs (e.g. the first SST 102 and the third SST 106) may be combined with one another (e.g. attached or otherwise connected to one another) to be used in together as a combination tool. For example, the third SST 106 may be connected to the first SST 102 in order to increase the amount of torque that a user can apply using one of the wrenches of the first SST 102. In some embodiments, the SSTs are fine blanked and finish machined to form the bodies of the SSTs. In other embodiments, the SSTs may be formed by injection molding (e.g., metal, plastic, etc.), casting (e.g., investment, die casting, etc.), or other appropriate tool forming process. In some embodiments, the SST system may include additional components or tools than those illustrated in the exemplary embodiment.

FIGS. 3-8 illustrate the first SST 102 or sight wrench according to an exemplary embodiment. The first SST 102 includes multiple tool structures. These tool structures include two open hex wrenches 110 and 112, a firing pin scraper/cleaner 114, an accessory flat head driver 116, a sight post wrench 118, and a closed hex wrench 120. In the illustrated embodiment, the open hex wrench 110 is sized at ⅜ inch, the open hex wrench 112 is sized at ¾ inch, and the closed hex wrench 120 is sized at ⅜ inch. These sizes correspond to fasteners or other components of members of the AR family of rifles. For example, the ¾ inch open hex wrench 112 is sized to engage a standard sized muzzle device (e.g. a flash hider or flash suppressor). In other embodiments, one or more of the hex wrenches may be sized differently. The firing pin scraper/cleaner 114 is used to scrape or clean a firing pin. The accessory flat head driver 116 is used to engage the adjustment or attachment mechanism of rail mounted accessories (e.g. a scope, a light, a sight, or other rail mounted accessory). The driver 116 may replace of a flat head screwdriver or a quarter for this task. The sight post wrench 118 is used to adjust a sight post of the fire arm. The sight post wrench 118 includes four protrusions. The sight post wrench 118 is fixedly attached to the body of the first SST 102 by a screw 122. In other embodiments, different methods of fixedly attaching the sight post wrench 118 to the body of the first SST 102 may be used (e.g., welding, etc.). The sight post wrench 118 is not pivotable relative to the body of the first SST 102. The sight post wrench 118 is not removable from the body of the first SST 102 without the use of additional tools.

FIGS. 9-12 illustrate the second SST 104 or buffer wrench according to an exemplary embodiment. The second SST 104 includes multiple tool structures. These tool structures include two open hex wrenches 124 and 126, a buffer tube wrench 128, and a closed hex wrench 130. In the illustrated embodiment, the open hex wrench 124 is sized at ¼ inch, the open hex wrench 126 is sized at ½ inch, and the closed hex wrench 130 is sized at ⅜ inch. These sizes correspond to fasteners or other components of members of the AR family of rifles. In other embodiments, one or more of the hex wrenches may be sized differently. The buffer tube wrench 128 is sized and shaped to engage the buffer tube nut (i.e., a castle nut) from a member of the AR family of rifles. The second SST 104 also includes a magnet 132 in the illustrated embodiment. An angled or tapered surface 134 is located proximate the end 136 of the second SST 104 opposite the closed hex wrench 130. The surface 134 is shaped this way in order to fit in storage compartments that include a taper or narrowing in this direction (e.g., the tapering storage compartment frequently found in the grip of a rifle of the AR family).

FIGS. 13-18 illustrate the third SST 106 or torque arm according to an exemplary embodiment. The third SST 106 includes multiple tool structures. These tool structures include a scraper 138, a closed hex wrench 140, a bolt carrier scraper 142, a cleaning cable aperture 144 that includes a round hole or opening 146 and an elongated slot 148, and a male hex wrench 150. For example, a cleaning cable may be fed through the cleaning cable aperture 144, which may be used as a handle for pulling the cleaning cable through the barrel of a rifle. The cleaning cable aperture 144 may be configured to be used with any number or type of cleaning cable, including those manufactured by Otis Technology. The scraper 138 is a general purpose scraper and may be used to clean carbon or other deposits from a firearm. The bolt carrier scraper 142 is the profile of the arm of the third SST 106 and is sized and shaped to function to clean a bolt carrier. The cleaning cable aperture 144 is used to hold a cable cleaner. The cable cleaner may be inserted through the hole 146 and slid into the elongated slot 148 to secure the cable to provide the user with additional leverage on the cleaning cable when cleaning a firearm. In the illustrated embodiment, the male hex wrench 150 is press fit into an aperture 152 formed through the body of the third SST 106 and is further secured to the body with a screw 154. Other attachment mechanisms are possible including, welding, press fitting alone, and using a screw or other fastener alone. The male hex wrench 150 includes a threaded aperture 156 that allows various accessories to be attached to the third SST 106. For example, the threaded aperture 156 may have 8/32 inch threads, which is used to connect various standard sized cleaning accessories (e.g. picks, scrapers, brushes etc.) to the third SST 106. The third SST 106 also includes a magnet 158.

FIGS. 19-25 illustrate the bit holder 108 according to an exemplary embodiment. The bit holder 108 includes a main body 160 having two apertures 162 and 164 formed therethrough. Each aperture 162 and 164 is sized and shaped to receive a bit driver. As illustrated, two bit drivers 166 and 168 are provided (e.g. a #0 cross or Phillips bit driver 166 and T10 hexalobular bit driver 168). The bit holder 108 also includes a first coupling portion 170 sized and shaped like the open hex wrench 126 of the second SST 104, a second coupling portion 172 sized and shaped like the open hex wrench 110 of the first SST 102, and a flange or stop 174. The first coupling portion 170 is adjacent the body 160 and the second coupling portion 172 is located between the first coupling portion 170 and the flange 174. In some embodiments, the bit holder 108 is made from a resilient material which may help to reduce the noise (e.g. rattling) when the SST system 100 is stored within a storage compartment of a firearm.

The SST system 100 is usable in multiple modes of operation. In a first mode of operation the three SSTs 102, 104, and 106 are coupled to one another in a storage configuration. To couple the three SSTs 102, 104, and 106 together in the storage configuration, the male hex wrench 150 of the third SST 106 is first inserted through the closed hex wrench 130 of the second SST 104 and then through the closed hex wrench 120 of the first SST 102. The longitudinal axes of the three SSTs 102, 104, and 106 are aligned in the storage configuration. The magnets 132 and 158 of the second SST 104 and the third SST 106, respectively, magnetically engage with one another as well as the metal body of the first SST 102 to act as an additional connecting mechanism between the SSTs (i.e., in addition the connection provided by the male hex wrench and the closed hex wrenches of the SSTs). In embodiments including the bit holder 108, the bit holder is coupled to the first SST 102, the second SST 104, and the third SST 106 in the storage configuration. The first coupling portion 170 is received within the open hex wrench 126 of the first SST 102, the second coupling portion 172 is received within the open hex wrench 110 of the first SST 102, and the flange 174 overhangs and engages the outer surface of the first SST 102. This coupling acts as an additional connecting mechanism between the SSTs (i.e., in addition the connection provided by the male hex wrench and the closed hex wrenches of the SSTs).

Figure 36:
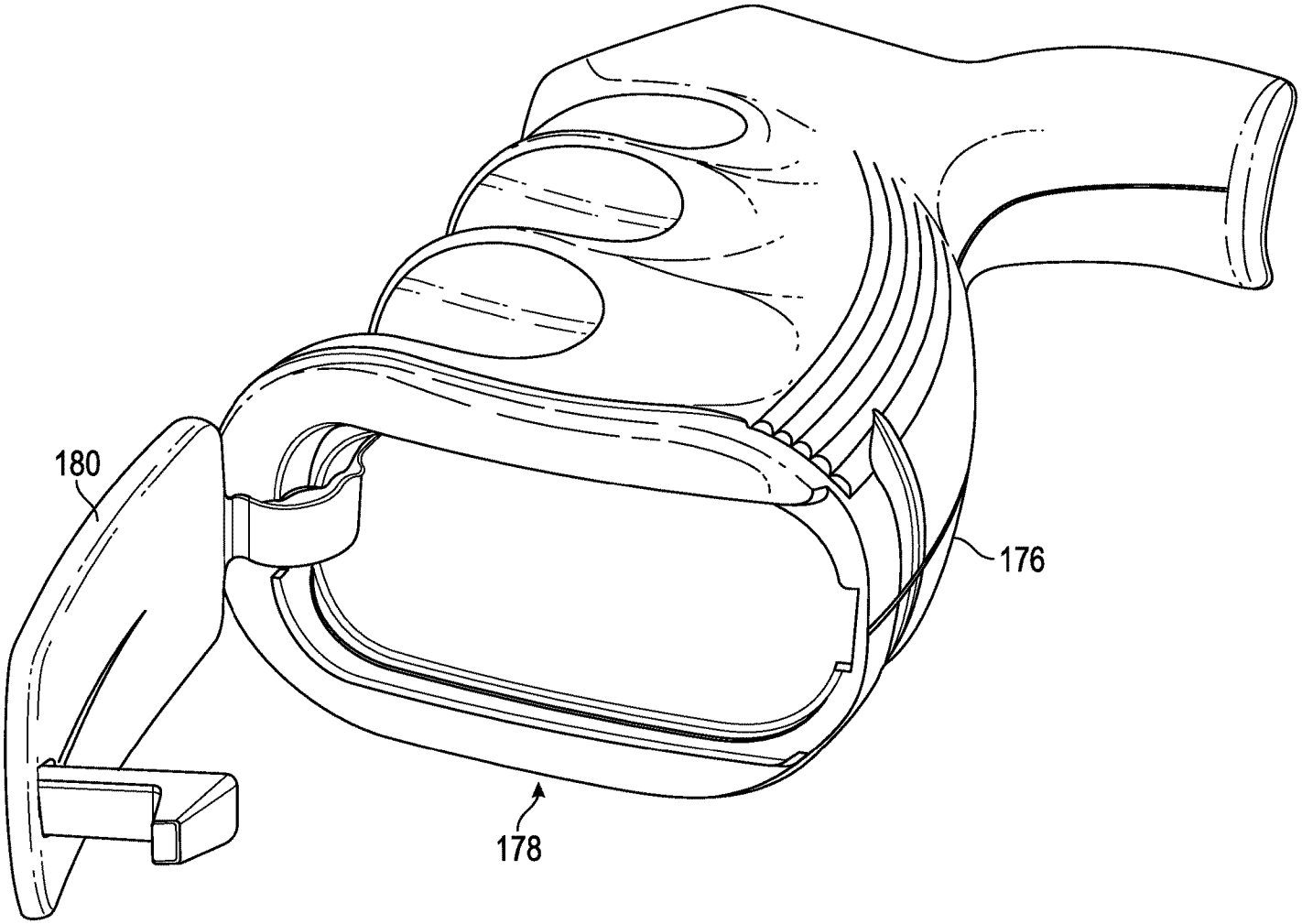
FIG. 36 is a perspective view of a rifle grip including a storage compartment.

In a preferred embodiment, the SST system 100 in the storage configuration has an overall width of about 0.6 inches, an overall length of about 2.95 inches and an overall height of about 1.2 inches. This relatively compact size of the storage configuration enables the SST system 100 to fit within a storage compartment of a firearm, in particular a storage compartment of an AR family rifle. This relatively compact size of the storage configuration also enables the SST system 100 to comfortably fit in a pants pocket. FIG. 36 illustrates a firearm grip 176 including a storage compartment 178 and a storage compartment cover 180. When not in the storage configuration, the magnets 132 and 158 may also be used as magnetic securing devices to hold pins, cotter keys, nuts, bolts, or other components removed from the firearm when servicing the firearm (e.g., in order to not misplace or lose these components).

In a second mode of operation the first SST 102 is used as a tool by itself. For example, the open hex wrench 112 is used to remove a flash suppressor from the firearm.

In a third mode of operation the second SST 104 is used as a tool by itself. For example, the buffer tube wrench 128 is used to remove the buffer tube nut from the buffer tube of the firearm.

In a fourth mode of operation the third SST 106 is used as a tool by itself. For example, cleaning cable aperture 144 is used to secure a cleaning cable to clean the muzzle of the firearm.

Figure 37:
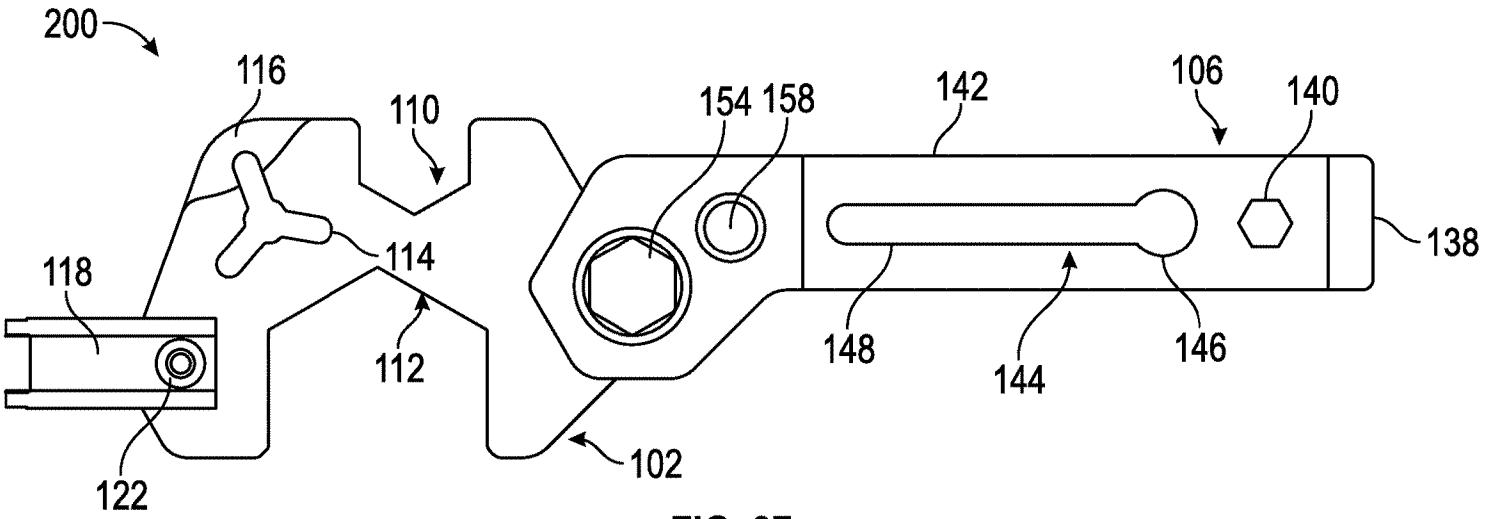
FIG. 37 is a front view of a first combination tool formed from components of the SST system of FIG. 1.

In further modes of operation, the third SST 106 is combined with an additional tool (e.g., the first SST 102, the second SST 104, the bit driver 166, the bit driver 168) and functions as a torque to increase the amount of torque the user can apply relative to the additional tool by itself. As shown in FIG. 37, in a fifth mode of operation, the first SST 102 is coupled to the third SST 106 and is used as a first combination tool 200. The male hex wrench 150 of the third SST 106 is inserted through the closed hex wrench 120 of the first SST 102 to couple the SSTs together as the first combination tool 200. A user is able to apply more torque with the open hex wrench 112 or other tool structures of the combination tool 200 than with the open hex wrench 112 of the first SST 102 by itself. For example, the user may be able to remove a sticky flash suppressor more easily with the combination tool 200 than with the first SST 102 by itself.

Figure 38:
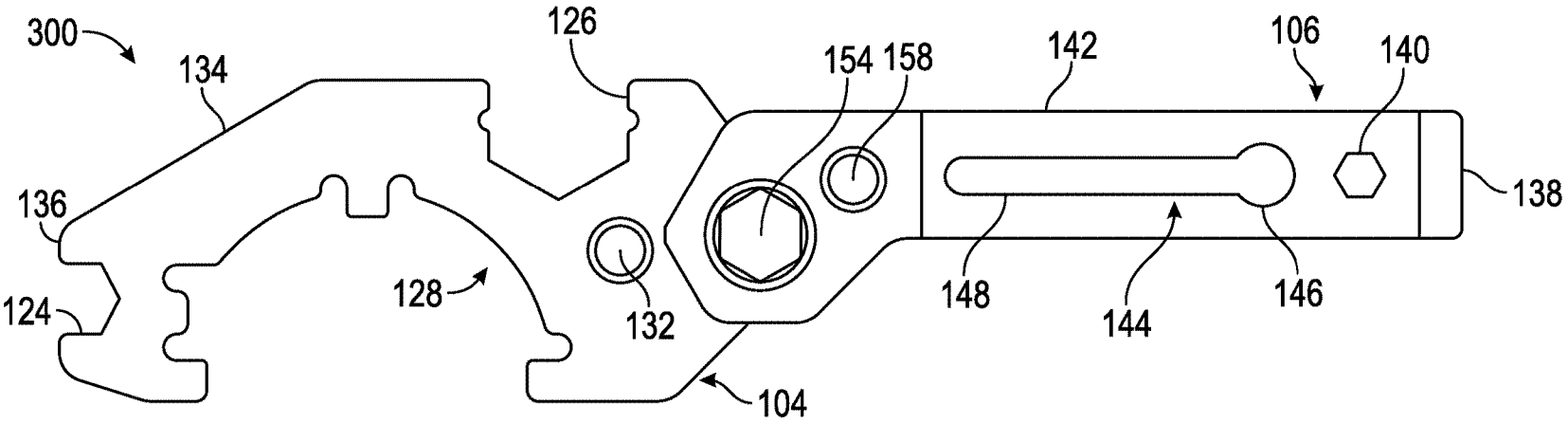
FIG. 38 is a front view of a second combination tool formed from components of the SST system of FIG. 1.

As shown in FIG. 38, in a sixth mode of operation, the second SST 104 is coupled to the third SST 106 and is used as a second combination tool 300. The male hex wrench 150 of the third SST 106 is inserted through the closed hex wrench 130 of the second SST 104 to couple the SSTs together as the second combination tool 300. A user is able to apply more torque with the buffer tube wrench 128 or other tool structures of the combination tool 300 than with the buffer tube wrench 128 of the second SST 104 by itself. For example, the user may be able to remove a sticky buffer tube nut more easily with the combination tool 300 than with the second SST 104 by itself.

In a seventh mode of operation, one of the bit drivers 166 and 168 is coupled to the third SST 106 and is used as a third combination tool. The base of the bit driver is inserted into the closed hex wrench 140 of the third SST 106 to couple the bit driver to the third SST 106. The third combination tool enables a user to apply greater torque with the bit driver than when using the bit driver on its own.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. A solid state tool system, comprising:

a first solid state tool;

a second solid state tool comprising a plurality of tool structures;

a third solid state tool comprising a plurality of tool structures;

a bit holder; and a bit driver;

wherein, in a first mode of operation, the first solid state tool, the second solid state tool, and the third solid state tool are coupled to one another in a storage configuration, the bit driver is coupled to the bit holder, and the bit holder is coupled to at least one of the first solid state tool, the second solid state tool, and the third solid state tool;

wherein, in a second mode of operation, the first solid state tool is used as a tool by itself;

wherein, in a third mode of operation, the second solid state tool is used as a tool by itself;

wherein, in a fourth mode of operation, the third solid state tool is used as a tool by itself;

wherein, in a fifth mode of operation, the first solid state tool is coupled to the third solid state tool and used as a first combination tool; and wherein, in a sixth mode of operation, the second solid state tool is coupled to the third solid state tool and used as a second combination tool.

2. The solid state tool system of claim 1, wherein the first solid state tool comprises a plurality of tool structures.

3. The solid state tool system of claim 2, wherein in a seventh mode of operation, the bit driver is used as a tool by itself, and wherein in an eighth mode of operation, the bit driver is coupled to the third solid state tool and used as a third combination tool.

4. The solid state tool system of claim 2, wherein the bit holder comprises a first coupling portion and a second coupling portion, and wherein, in the first mode of operation, the first coupling portion is received by the first tool structure and the second coupling portion is received by the second tool structure.

5. The solid state tool system of claim 1, wherein in a seventh mode of operation, the bit driver is used as a tool by itself, and wherein in an eighth mode of operation, the bit driver is coupled to the third solid state tool and used as a third combination tool.

6. The solid state tool system of claim 1, wherein the bit holder comprises a first coupling portion and a second coupling portion, and wherein, in the first mode of operation, the first coupling portion is received by the first tool structure and the second coupling portion is received by the second tool structure.

7. A solid state tool system, comprising:

a first solid state tool comprising a first tool structure and a first closed hex wrench;

a second solid state tool comprising a second tool structure and a second closed hex wrench;

a third solid state tool comprising a third tool structure and a male hex wrench;

a bit holder; and a bit driver;

wherein, in a first mode of operation, the first solid state tool, the second solid state tool, and the third solid state tool are coupled to one another in a storage configuration by inserting the male hex wrench through the second closed hex wrench and the first closed hex wrench so that the second solid state tool is positioned between the first solid state tool and the third solid state tool;

wherein, in a first mode of operation, the bit driver is coupled to the bit holder, and the bit holder is coupled to the first solid state tool, the second solid state tool, and the third solid state tool;

wherein, in a second mode of operation, the first solid state tool is coupled to the third solid state tool by inserting the male hex wrench through the first closed hex wrench; and wherein, in a third mode of operation, the second solid state tool is coupled to the third solid state tool by inserting the male hex wrench through the second closed hex wrench.

8. The solid state tool system of claim 7, wherein, in a fourth mode of operation, the first tool structure of the first solid state tool is used as a tool by itself;

wherein, in a fifth mode of operation, the second tool structure of the second solid state tool is used as a tool by itself; and wherein, in a sixth mode of operation, the third tool structure of the third solid state tool is used as a tool by itself.

9. The solid state tool system of claim 7, wherein the bit holder comprises a first coupling portion and a second coupling portion; and wherein, in the first mode of operation, the first coupling portion is received by the first tool structure and the second coupling portion is received by the second tool structure.

10. A solid state tool system, comprising:

a first solid state tool;

a second solid state tool;

a third solid state tool;

a bit holder; and a bit driver;

wherein, in a first mode of operation, the first solid state tool, the second solid state tool, and the third solid state tool are coupled to one another in a storage configuration;

wherein in the first mode of operation the bit driver is coupled to the bit holder and the bit holder is coupled to at least one of the first solid state tool, the second solid state tool, and the third solid state tool;

wherein, in a second mode of operation, the first solid state tool is used as a tool by itself;

wherein, in a third mode of operation, the second solid state tool is used as a tool by itself;

wherein, in a fourth mode of operation, the third solid state tool is used as a tool by itself;

wherein, in a fifth mode of operation, the first solid state tool is coupled to the third solid state tool and used as a first combination tool; and wherein, in a sixth mode of operation, the second solid state tool is coupled to the third solid state tool and used as a second combination tool;

wherein in a seventh mode of operation, the bit driver is used as a tool by itself; and wherein in an eighth mode of operation, the bit driver is coupled to the third solid state tool and used as a third combination tool.

11. The solid state tool system of claim 10, wherein the bit holder comprises a first coupling portion and a second coupling portion, and wherein, in the first mode of operation, the first coupling portion is received by the first tool structure and the second coupling portion is received by the second tool structure.

* * * * *